US012349845B2

(12) United States Patent
Ng et al.

(10) Patent No.: US 12,349,845 B2
(45) Date of Patent: Jul. 8, 2025

(54) FLOOR MOPPING SYSTEM FOR AN AUTONOMOUS CLEANING APPARATUS

(71) Applicant: LIONSBOT INTERNATIONAL PTE. LTD., Singapore (SG)

(72) Inventors: Dylan Terntzer Ng, Singapore (SG); Mohan Rajesh Elara, Singapore (SG); Tushar Mohan, Singapore (SG); Hoong Ching Lim, Singapore (SG)

(73) Assignee: LIONSBOT INTERNATIONAL PTE. LTD., Singapore (SG)

( * ) Notice: Subject to any disclaimer, the term of this patent is extended or adjusted under 35 U.S.C. 154(b) by 390 days.

(21) Appl. No.: 17/907,848

(22) PCT Filed: Nov. 19, 2020

(86) PCT No.: PCT/SG2020/050675
§ 371 (c)(1),
(2) Date: Aug. 29, 2022

(87) PCT Pub. No.: WO2021/173074
PCT Pub. Date: Sep. 2, 2021

(65) Prior Publication Data

US 2023/0131655 A1 Apr. 27, 2023

(30) Foreign Application Priority Data

Feb. 28, 2020 (SG) ..... 10202001829Q

(51) Int. Cl.
*A47L 11/282* (2006.01)
*A47L 11/40* (2006.01)

(52) U.S. Cl.
CPC ..... *A47L 11/282* (2013.01); *A47L 11/4011* (2013.01); *A47L 11/4016* (2013.01);
(Continued)

(58) Field of Classification Search
CPC ..... A47L 11/14; A47L 11/145; A47L 11/18; A47L 11/185
See application file for complete search history.

(56) References Cited

U.S. PATENT DOCUMENTS

2019/0290089 A1* 9/2019 Johnson ..... A47L 11/4013

FOREIGN PATENT DOCUMENTS

CN 202341952 U 7/2012
CN 108294700 A 7/2018
(Continued)

OTHER PUBLICATIONS

International Search Report and Written Opinion of International Searching Authority dated Feb. 10, 2021 for International Application No. PCT/SG2020/050675.
(Continued)

*Primary Examiner* — Shay Karls
(74) *Attorney, Agent, or Firm* — Joseph G. Chu; JCIP

(57) ABSTRACT

A floor mopping system (3) for an autonomous cleaning apparatus (1)65), comprising a mop roller assembly (5) including a mop roller (9) and a drive mechanism (19) for rotatably driving the mop roller about a longitudinal axis thereof, wherein the mop roller assembly is supported on a suspension assembly (63) comprising an adaptive suspension mechanism (65) for providing at least 3 degrees of movement for the mop roller assembly.

11 Claims, 12 Drawing Sheets

(52) U.S. Cl.
CPC ..... *A47L 11/4041* (2013.01); *A47L 11/4044* (2013.01); *A47L 11/4055* (2013.01); *A47L 11/4069* (2013.01); *A47L 11/4088* (2013.01); *A47L 2201/00* (2013.01)

(56) References Cited

FOREIGN PATENT DOCUMENTS

| | | | |
|---|---|---|---|
| CN | 209360582 | U | 9/2019 |
| JP | H09-75265 | A | 3/1997 |
| KR | 100848568 | B1 | 7/2008 |

OTHER PUBLICATIONS

International Preliminary Report on Patentability dated May 12, 2022 for International Application No. PCT/SG2020/050675.

* cited by examiner

FLOOR MOPPING SYSTEM FOR AN AUTONOMOUS CLEANING APPARATUS

FIELD

The present invention generally relates to autonomous cleaning apparatus, and in particular to a floor mopping system for such an apparatus.

BACKGROUND

The following discussion of the background to the invention is intended to facilitate an understanding of the present invention only. It should be appreciated that the discussion is not an acknowledgment or admission that any of the material referred to was published, known or part of the common general knowledge of the person skilled in the art in any jurisdiction as at the priority date of the invention.

Conventional floor mopping involves a microfiber cloth or cotton strings attached to a mopping stick. The user drags the mop front and back in order to remove the stains from the floor. This repetitive motion is crucial to achieve good cleaning results. However, attaching a microfiber cloth onto a moving autonomous cleaning apparatus, typically known as a cleaning robot, will not achieve the same results. This is because since the cleaning robot only moves in one direction during its autonomous navigation, and the dry stains on the floor cannot be cleaned.

Furthermore, in conventional mopping, the user can change the mop pads once they are dirty, or can wash the mop pad to allow them to be reused. However, the mopping mechanisms of existing cleaning robots have limited or no self-cleaning abilities for their mop pads. Existing cleaning robots also generally have fixed mop pads which do not demonstrate good cleaning results when used on floors having dry stains. Having a fixed pad also produced less than satisfactory cleaning results on uneven surfaces.

An object of the invention is to ameliorate one or more of the above-mentioned difficulties.

SUMMARY

According to an aspect of the present disclosure, there is provided a floor mopping system for an autonomous cleaning apparatus, comprising a mop roller assembly including a mop roller and a drive mechanism for rotatably driving the mop roller about a longitudinal axis thereof, wherein the mop roller assembly is supported on a suspension assembly comprising an adaptive suspension mechanism for providing at least 3 degrees of movement for the mop roller assembly.

In some embodiments, the mop roller assembly comprises a mop roller housing for accommodating the mop roller and the drive mechanism, the adaptive suspension system comprising one or more resilient supports interconnected to the mop roller housing for resiliently supporting the mop roller assembly.

In some embodiments, the adaptive suspension system comprises a support plate positioned in a generally parallel adjacent relationship to a top surface of the mop roller housing, the resilient support being located between the support plate and top surface thereof.

In some embodiments, the resilient support comprises a spherical bearing block respectively mounted on the support plate and top surface, a coil spring located between the support plate and top surface, and a guide pin extending through the spherical bearing blocks and the coil spring for locating the coil spring in position.

In some embodiments, the support plate is generally rectangular in shape, and wherein a said resilient support is respectively located at or adjacent each corner of the support plate.

In some embodiments, the suspension assembly further comprises a positioning mechanism for positioning the mop roller assembly between an elevated non-operational position, and a lowered operational position.

In some embodiments, the positioning mechanism comprises an actuator drive means comprising a drive screw for moving the mop roller assembly between said elevated and lowered positions.

In some embodiments, the drive mechanism comprises a drive motor, a mop roller drive assembly and a belt drive assembly interconnecting the drive motor and mop roller drive assembly, the mop roller drive assembly being interconnected to the mop roller.

In some embodiments, the floor mopping system further comprises a cleaning assembly for the mop roller.

In some embodiments, the cleaning assembly comprises a scrapper member in contact with the mop roller for extracting water therefrom.

In some embodiments, the cleaning assembly further comprises a tray member for receiving the extracted water, and drainage means for removing the water collected by the tray member.

In some embodiments, the mop roller assembly further comprises a static mopping pad having a removable mopping pad mounted thereon.

In some embodiments, the mop roller is removably mounted within the mop roller assembly.

According to another aspect of the present disclosure, there is provided an autonomous cleaning apparatus comprising a floor mopping system as described above.

In some embodiments, the autonomous cleaning apparatus comprises an electronic control system for controlling the operation of the floor mopping system, and a water supply system for supplying clean water to the floor mopping system and for collecting dirty water from the floor mopping system In some embodiments, the control system controls an interval of the supply of clean water to the floor mopping system.

Other aspects and features will become apparent to those of ordinary skill in the art upon review of the following description of specific embodiments in conjunction with the accompanying figures.

BRIEF DESCRIPTION OF THE DRAWINGS

In the figures, which illustrate, by way of example only, embodiments of the present invention.

DETAILED DESCRIPTION

Throughout this document, unless otherwise indicated to the contrary, the terms "comprising", "consisting of", "having" and the like, are to be construed as non-exhaustive, or in other words, as meaning "including, but not limited to".

Furthermore, throughout the specification, unless the context requires otherwise, the word "include" or variations such as "includes" or "including" will be understood to imply the inclusion of a stated integer or group of integers but not the exclusion of any other integer or group of integers.

Unless defined otherwise, all technical and scientific terms used herein have the same meaning as is commonly understood by a skilled person to which the subject matter herein belongs.

Figure 1:
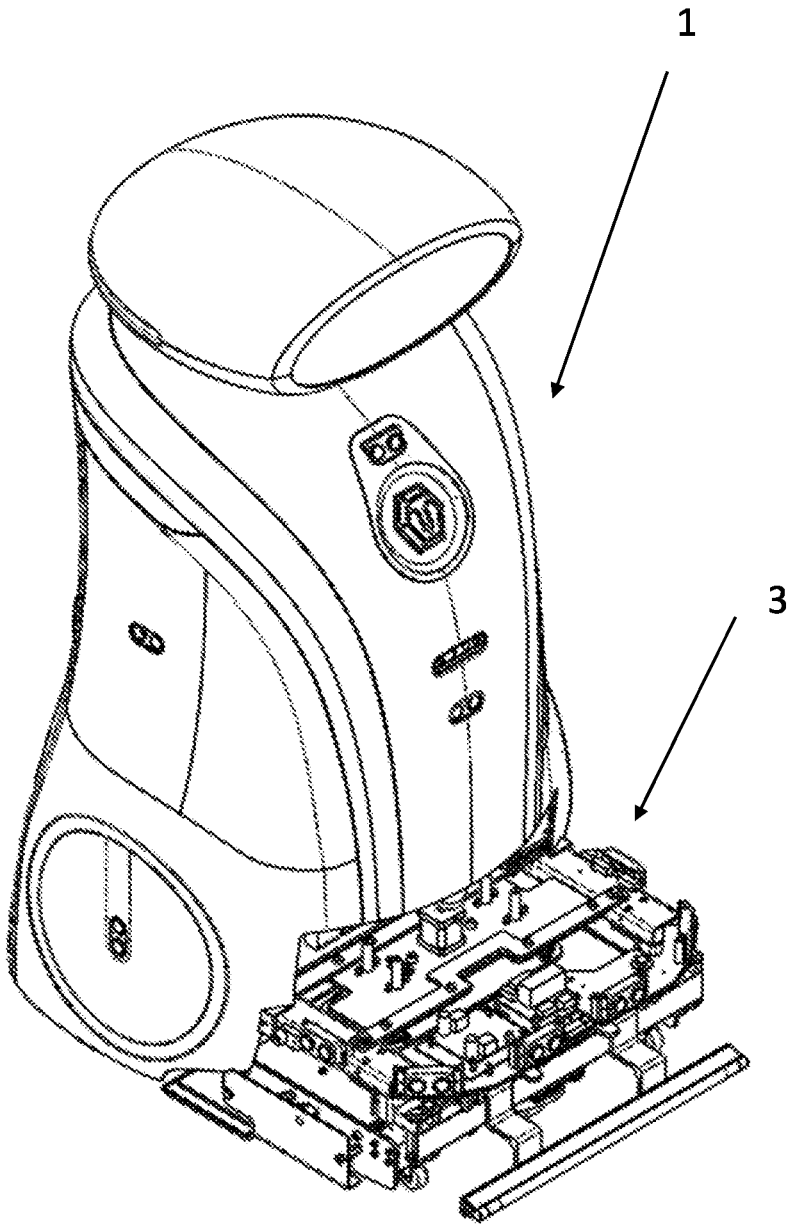
FIG. 1 is a perspective of an autonomous cleaning apparatus incorporating a floor mopping system according to the present disclosure.

Referring initially to FIG. 1, there is shown an autonomous cleaning apparatus 1, commonly known as a cleaning robot, within which is incorporated a floor mopping system 3 according to the present disclosure. The floor mopping system 3 is installed within a lower portion of the autonomous cleaning apparatus 1 to allow for contact of the floor mopping system 3 with a floor surface being traversed by the autonomous cleaning apparatus 1. The autonomous cleaning apparatus 1 further comprises a control system (not shown) for controlling the operation of the floor mopping system 3, and a water supply and collection system (not shown) including clean and dirty water tanks, pumps and supply and collection tubes for supplying cleaning water to the floor mopping system 3, and for collecting dirty water from the floor mopping system 3.

Figure 2:
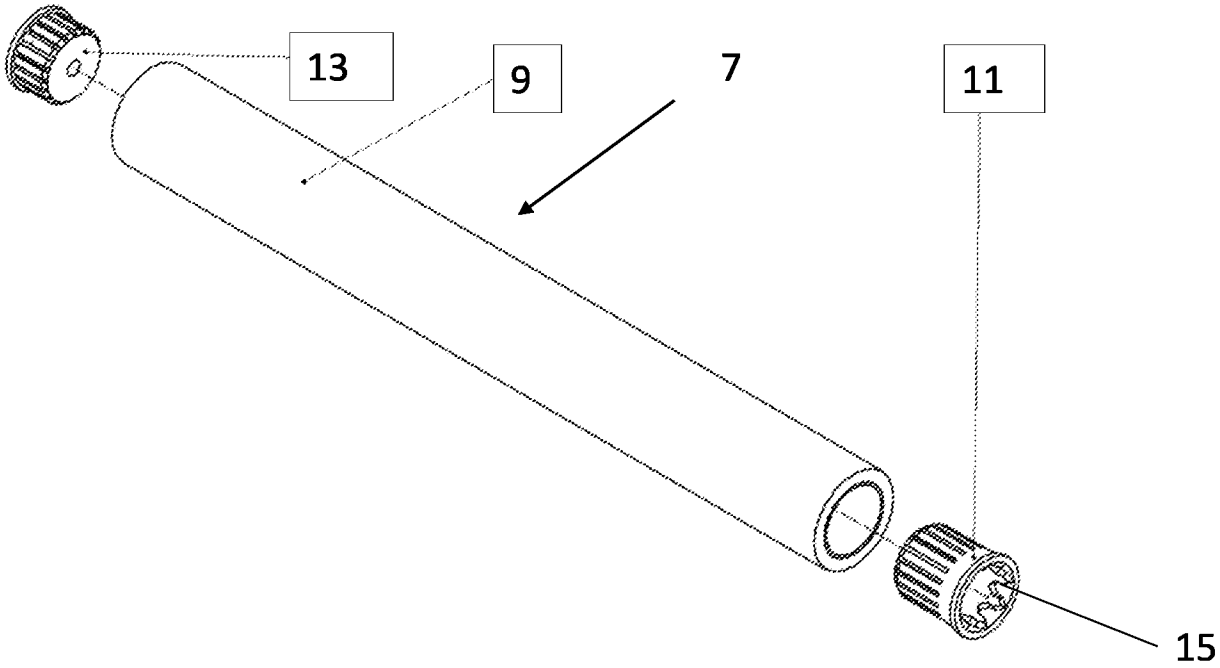
FIG. 2 is an exploded perspective view of a mop roller module according to the present disclosure.
Figure 3:
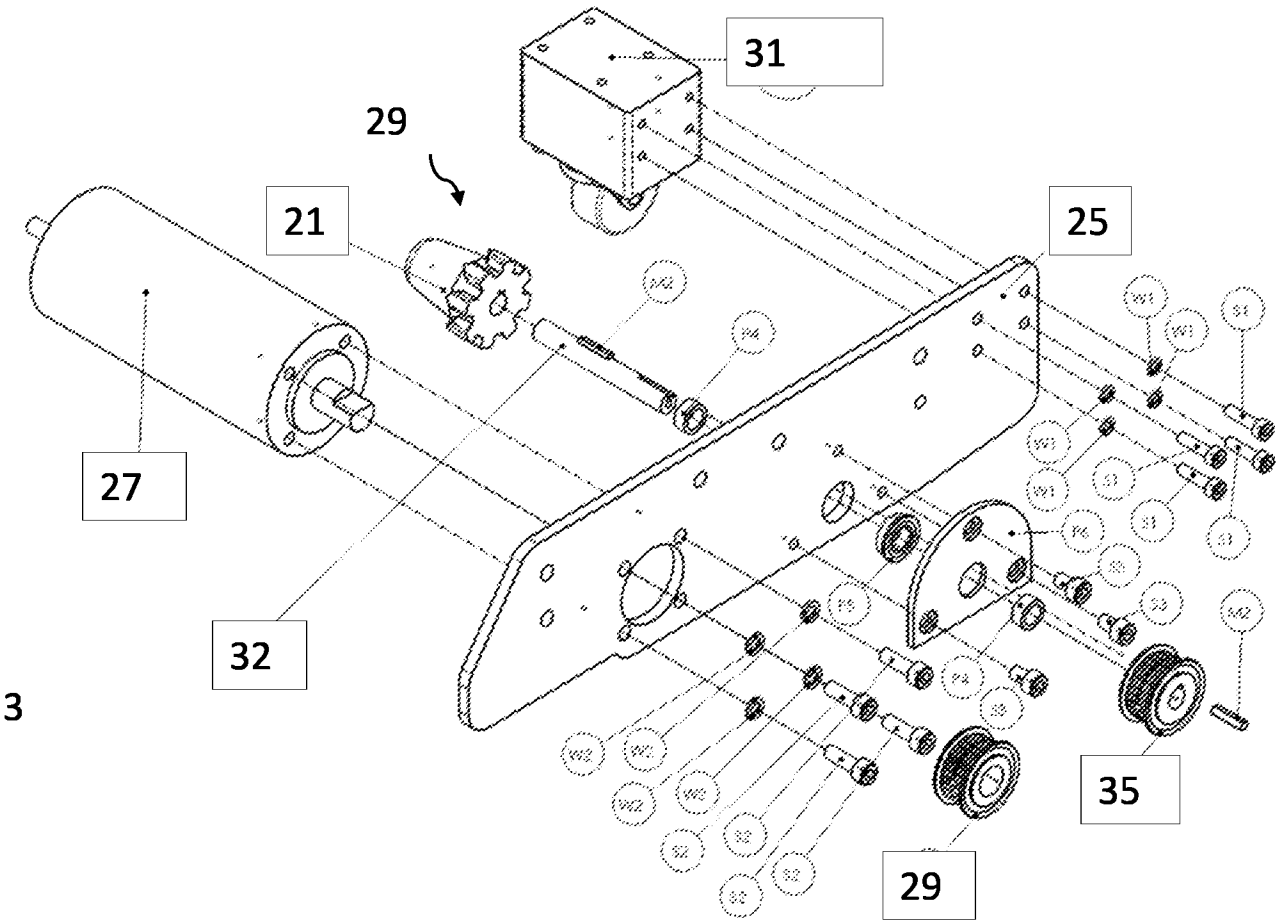
FIG. 3 is an exploded perspective view of a drive mechanism of the mop roller module of FIG. 2.
Figure 4:
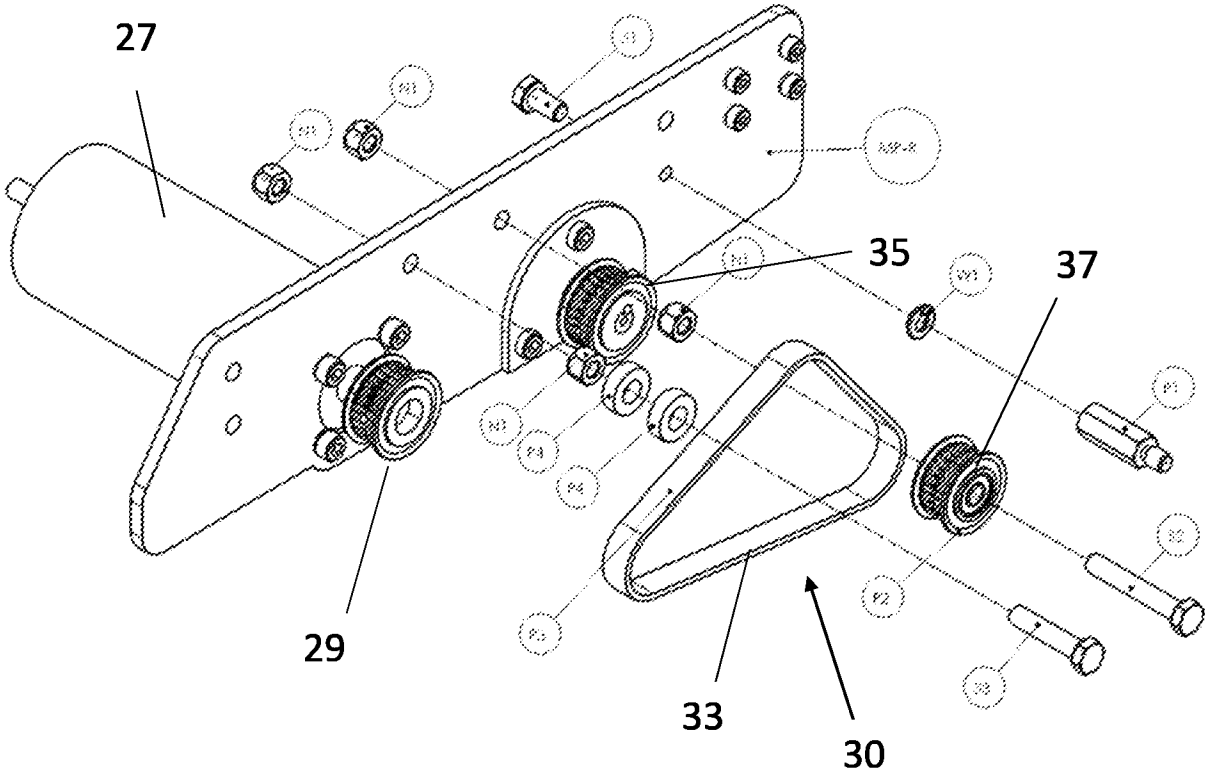
FIG. 4 is an exploded perspective view of a belt drive assembly for the drive mechanism of FIG. 3.
Figure 5:
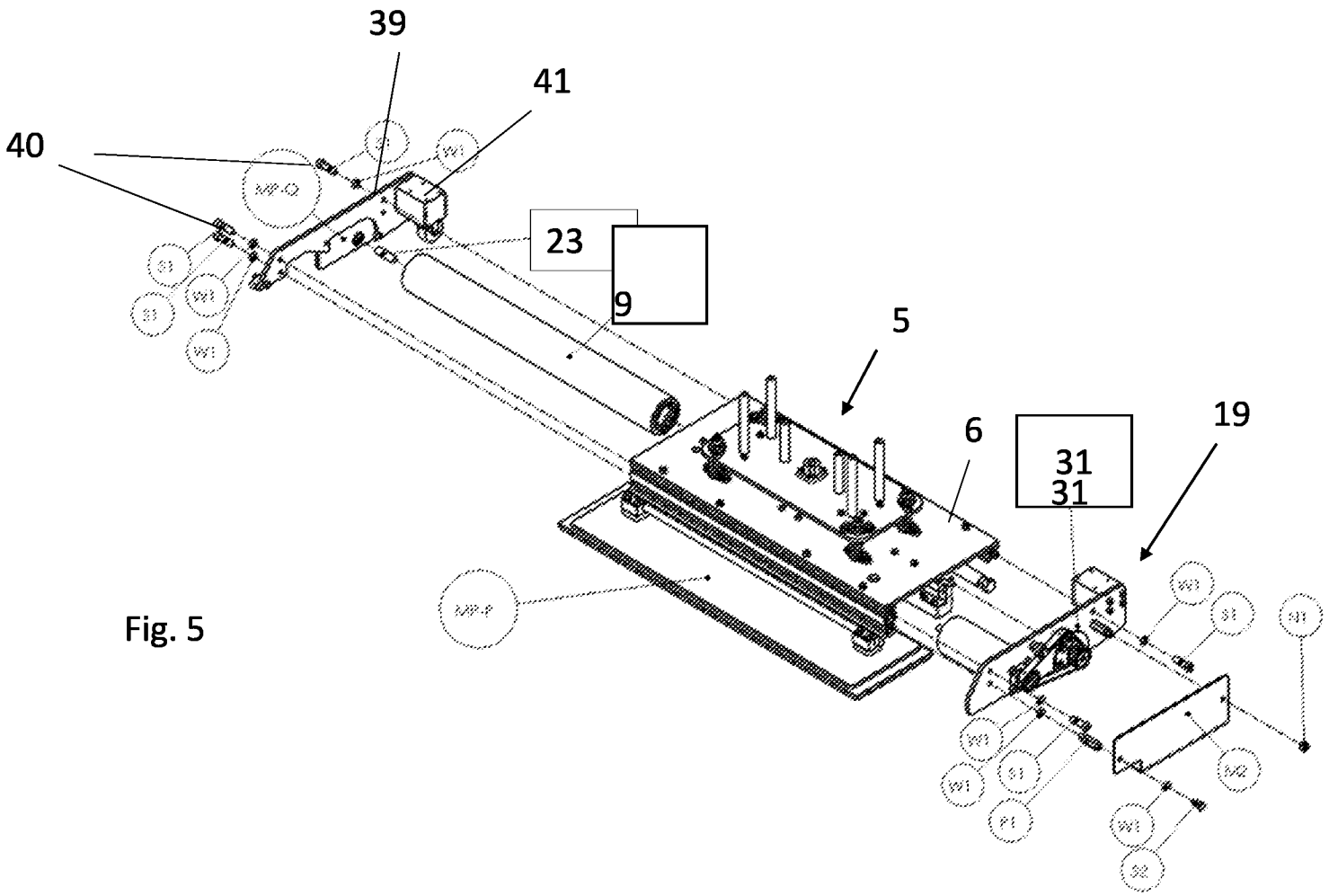
FIG. 5 is an exploded perspective view of a roller mop assembly according to the present disclosure.
Figure 6:
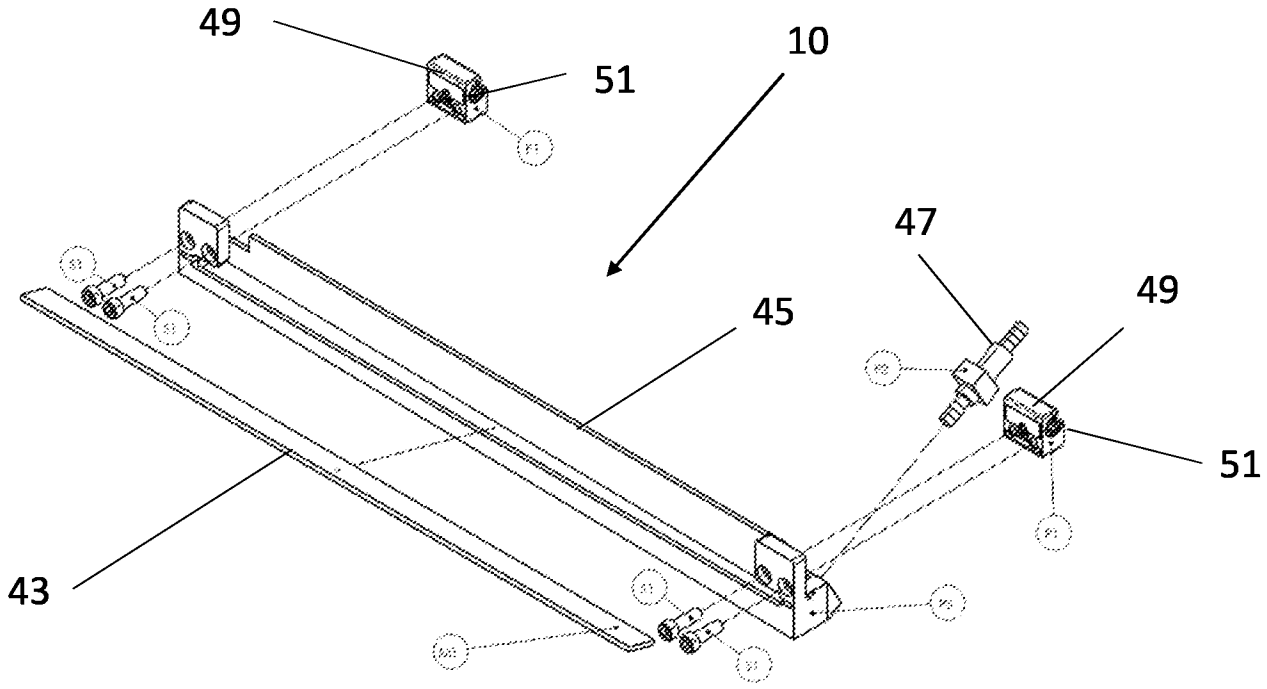
FIG. 6 is an exploded perspective view of a roller mop cleaning assembly according to the present disclosure.

FIGS. 2 to 9 shows in more detail various components of a mop roller assembly 5 of the floor mopping system 3 according to the present disclosure. The mop roller assembly 5 comprises a mop roller housing 6, within which is supported a roller mop module 7 and a drive mechanism 19 for the mop roller module 7. FIG. 2 shows the mop roller module 7 having a mop roller 9, and end connectors 11, 13 respectively secured to opposing ends of the mop roller 9. The mop roller 9 may for example be made from an absorbent nylon material, although the use of other absorbent materials is also envisaged. The mop roller 9 is supported for rotation about a longitudinal axis 17 of the mop roller 9 via the end connectors 11,13. One connector 11 include a drive connection 15 in the form of an inner cavity having internal gear teeth, the cavity being thereby shaped to accommodate and engage with a drive gear 21 of the mop roller drive mechanism 19 as shown in FIG. 3. The opposing connector 13 is mounted on a bearing 23 as shown in FIG. 5 that allows for free rotation of the opposing connector 13. The drive mechanism 30 is adapted to drive the mop roller module 7 about its longitudinal axis 17 during the working operation of the floor mopping system 3.

Referring now specifically to FIGS. 3 and 4, the roller mop drive mechanism 19 comprises a first mounting plate 25 to which is fixedly mounted a mop roller drive motor 27, and a rotatably mounted mop roller drive assembly 29, The mop roller drive assembly 29 comprises a drive shaft 32 supporting at one thereof the drive gear 21 connectable to the mop roller module 7. A first wheel assembly 31 is also connected to the first mounting plate 25, the use of which will be subsequently described. The mop roller drive motor 27 drives a drive pulley 29 which in turn drives a belt drive assembly 30 comprising a drive belt 33, a shaft pulley 35 mounted on the mop roller drive shaft 32, and a support pulley 37 rotatably mounted on the mounting plate 25. The mop roller module 7 can therefore be driven for rotation by the mop roller drive motor 27 via the belt drive 30.

Referring now to FIG. 5, the drive mechanism 19 is secured to one end of a mop roller housing 6 within which can be accommodated therein the mop roller module 7. The opposing end of the mop roller housing 6 supports a second mounting plate 39 supporting the bearing 23 upon which the free end connector 13 of the mop roller module 7 can be mounted. The second mounting plate 39 may further support a second wheel assembly 41, which works together with the first wheel assembly 31 to support the mop roller assembly 5 on a underlying floor surface. The second mounting plate 39 may be releasably attached to the opposing end of the mop roller housing 6 using fastening means 40 such as a plurality of bolt and nut sets. This facilitates the removal and replacement of the mop roller module 7 from within the mop roller assembly 5.

Figure 8:
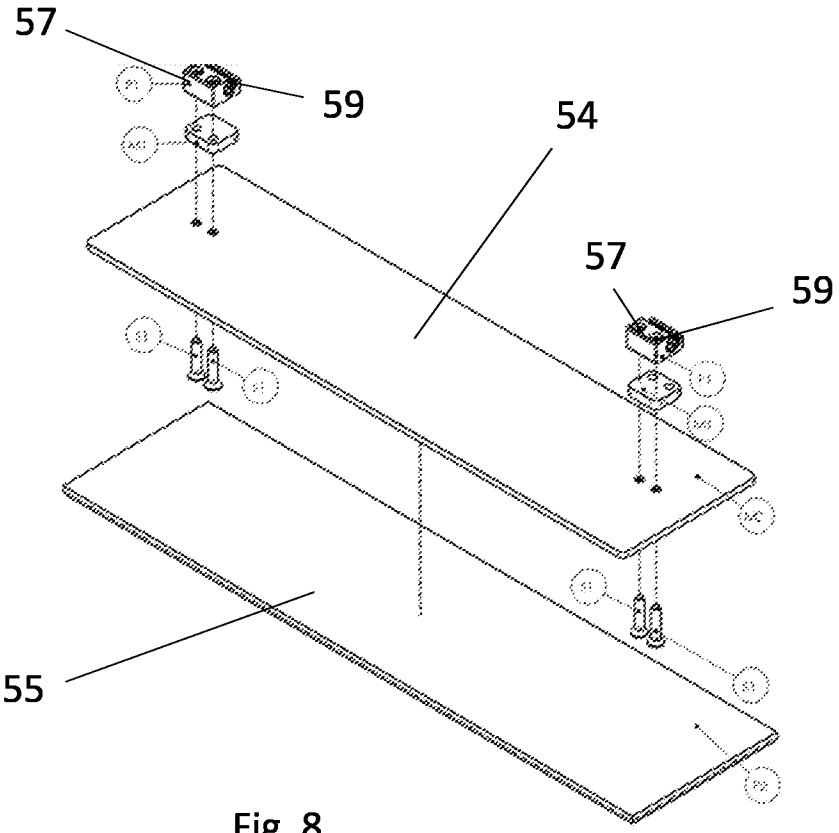
FIG. 8 is an exploded perspective view of the static mopping pad of FIG. 7.
Figure 9:
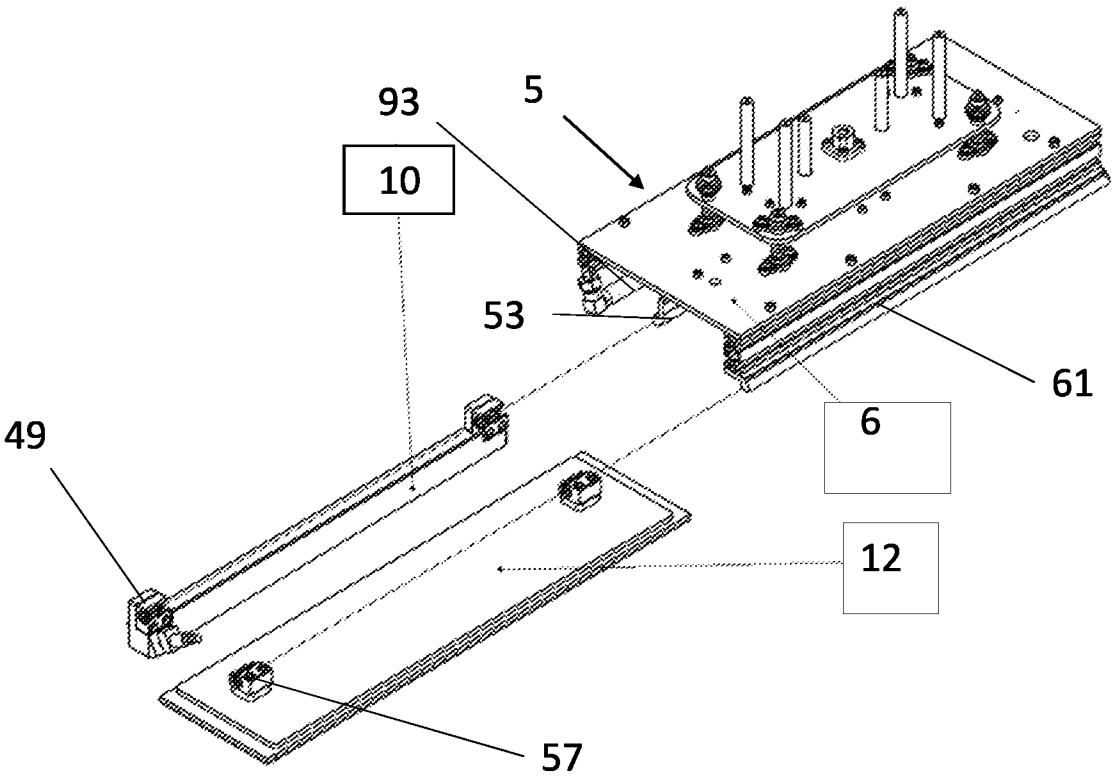
FIG. 9 is an exploded perspective view of the roller mop assembly showing the installation of the roller mop cleaning assembly of FIG. 6 and the static mopping pad of FIGS. 7 and 8.
Figure 10:
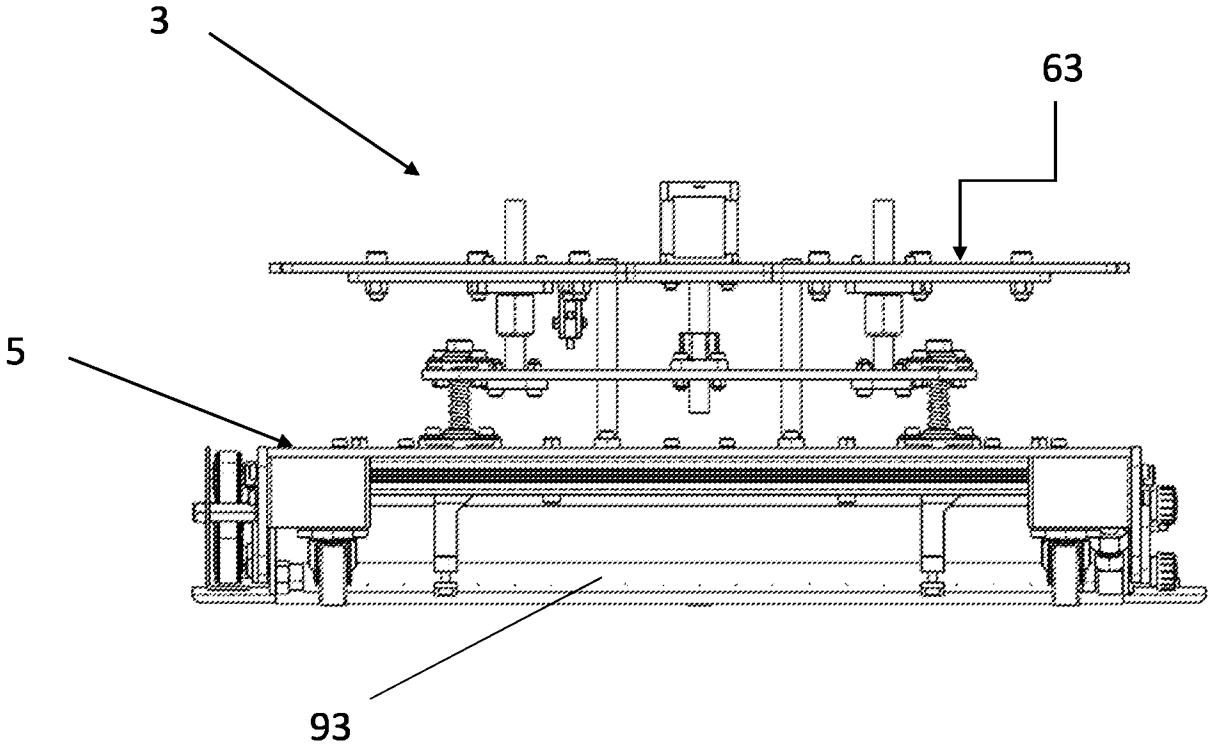
FIG. 10 is a front view of the floor mopping system according to the present disclosure.
Figure 12:
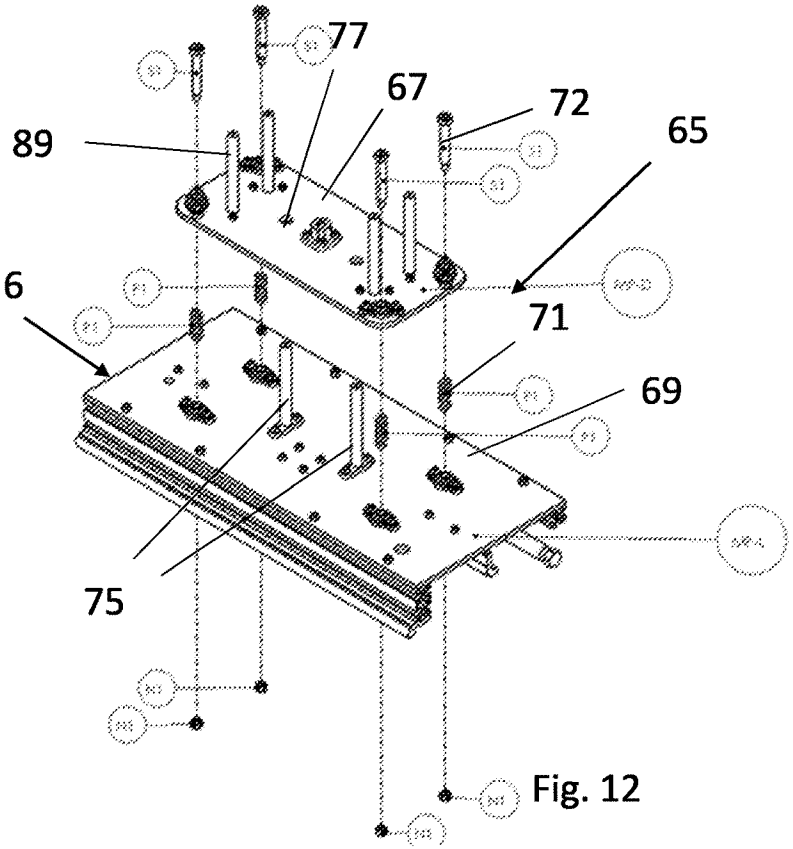
FIG. 12 is an exploded perspective view of an adaptive suspension mechanism of the floor mopping assembly.
Figure 11:
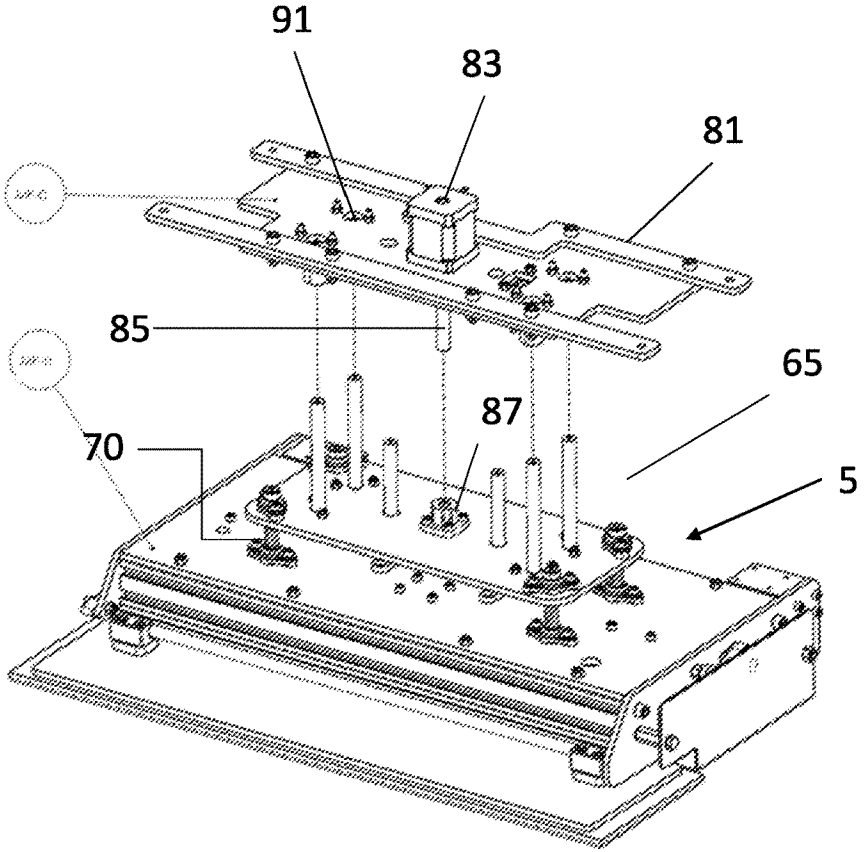
FIG. 11 is a partially exploded perspective view of the floor mopping assembly showing a positioning mechanism of the floor mopping system of FIG. 10.
Figure 13:
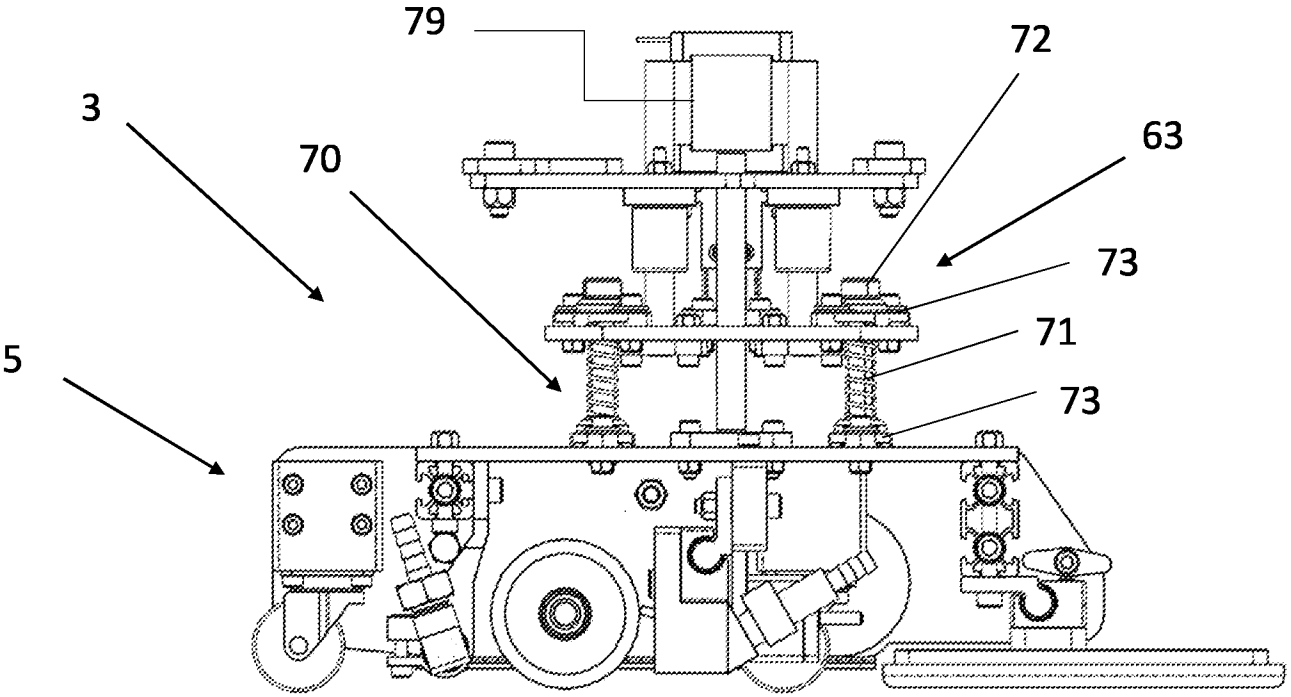
FIG. 13 is a side view of the floor mopping system according to the present disclosure.

Referring now to FIGS. 6 to 9, the floor mopping system 3 further comprises a cleaning assembly 10 for cleaning of the mop roller 9 during working operation thereof. The cleaning assembly 10 comprises a scrapper member 43, and a tray member 45. The scrapper member 43 can be located and attached in a parallel adjacent relationship to the tray member 45. The cleaning assembly 10 can be located in a position where the scrapper member 43 is held in contact with the mop roller 9 within the mop roller assembly 5. The scrapper member 43 can therefore squeeze dirty water from the mop roller 9 during rotation thereof. Clean water can be initially sprayed onto the mop roller 9 by a spray member 93 formed from an elongate tube having a series of spray holes extending therealong. Clean water is supplied to the spray member 93 via a pump (not shown) from the clean water tank (not shown) within the cleaning apparatus 1. The spraying can be controlled by the electronic control system of the autonomous cleaning apparatus 1, and the interval of spraying controlled internally or externally by, for example, a mobile app. The dirty water from the mop roller 9 can then be directed by the scrapper member 43 to the tray member 45. The water collected by the tray member 45 can then be directed to a drain outlet connector 47 provided at one end of the tray member 45. This enables the dirty water to be pumped from the tray member 45 via a dosing pump (not shown) to the dirty water tank (not shown) provided within the autonomous cleaning apparatus 1. The cleaning assembly 10 further comprises a pair of mounting blocks 49 which may be respectively secured in a spaced apart relationship on the tray member 45. Each mounting block 49 may have a channel 51 therein shaped to accommodate and allow for sliding movement of the cleaning assembly 10 along a support rib 53 provided within the mop roller housing 6 as shown in FIG. 9.

Figure 7:
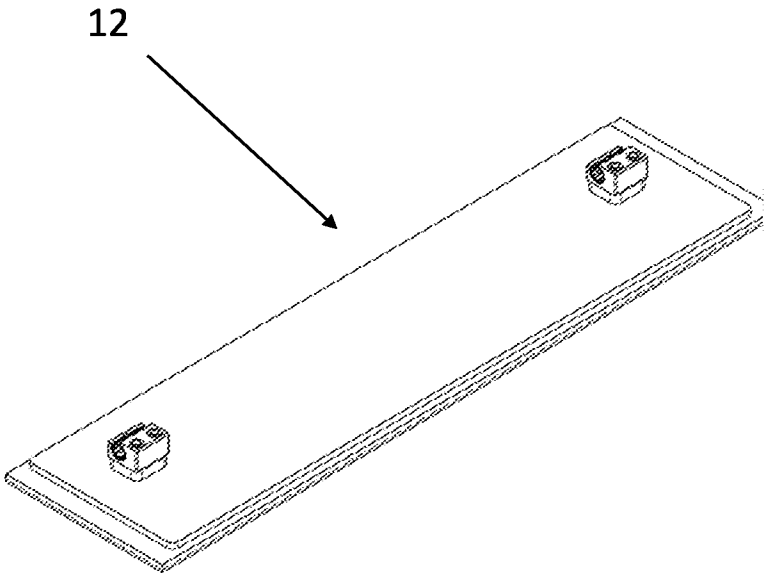
FIG. 7 is a perspective view of a static mopping pad according to the present disclosure.

The floor mopping system 3 may further comprise a static mopping pad 12 as shown in FIGS. 7 and 8. The static mopping pad 12 may comprise a planar pad holder 54, and a mopping pad 55 that can be releasably secured to the pad holder 54 via securing or adhering means, including for example Velcro (trademark) tape. The mopping pad 55 may be made of microfibre material. It is however also envisaged that the mopping pad 55 be made of other absorbent material including fabric or paper. A pair of mounting blocks 57 may be respectively secured in a spaced a part relation on the pad holder 54. Each mounting block 57 may have a channel 59 therein shaped to accommodate and allow sliding movement along a peripheral edge 61 of the mop roller housing 61 as shown in FIG. 9. This facilitates removal of the static mopping pad 12 from the floor mopping system 3 when the mopping pad 55 needs to be replaced or cleaned. The mopping pad 55 is provided to wipe away any excess water trails left on the floor surface being cleaned after the mop roller 9 has been in contact with the floor surface while the autonomous cleaning apparatus 1 traverses that floor surface.

FIGS. 10 to 13 show a suspension assembly 63 for supporting the mop roller assembly 5. The suspension assembly 63 comprises an adaptive suspension mechanism 65 that may both support the roller mop assembly 5 and allow for movement of the mop roller assembly 5 with at least 3 degrees of freedom (DOF). The adaptive suspension system 65 may resiliently support the mop roller assembly 5 to thereby allow for such movement. The adaptive suspension mechanism 65 may comprise a support plate 67 located in a generally parallel and adjacent relationship above a top surface 69 of the mop roller housing 6. The support plate may be generally rectangular in shape and may be provided with resilient supports 70 at or adjacent each corner of the support plate 67 with each resilient support 70 located between the support plate 67 and the mop roller housing top surface 69. Each resilient support 70 may be respectively interconnected to the support plate 67 and top surface 69 via spherical bearing blocks 73 respectively mounted on the support plate 67 and top surface 69. The resilient support 70 may further include a coil spring 71 located between the support plate 67 and top surface 69, a guide pin 72 extending through the bearing block 73 mounted on the support plate 67, through the spring 71 to locate and maintain in position the spring 71 between the support plate 67 and mop roller housing top surface 69, and through the bearing block 73 mounted on the top surface 69. The guide pin 72 can both pivot and be angularly displaced within each bearing block 73. One or more guide posts 75 may extend upwardly from the mop roller housing top surface 69 and through apertures 77 provided within the support plate 77 to thereby generally constrain any sideway motion of the support plate 67 while allowing generally vertical motion of the support plate 67 relative to the mop roller housing top surface 69. This adaptive suspension mechanism 65 therefore allows for movement of the supported mop roller assembly 5 in at least 3 DOF.

Figures 14, 15:
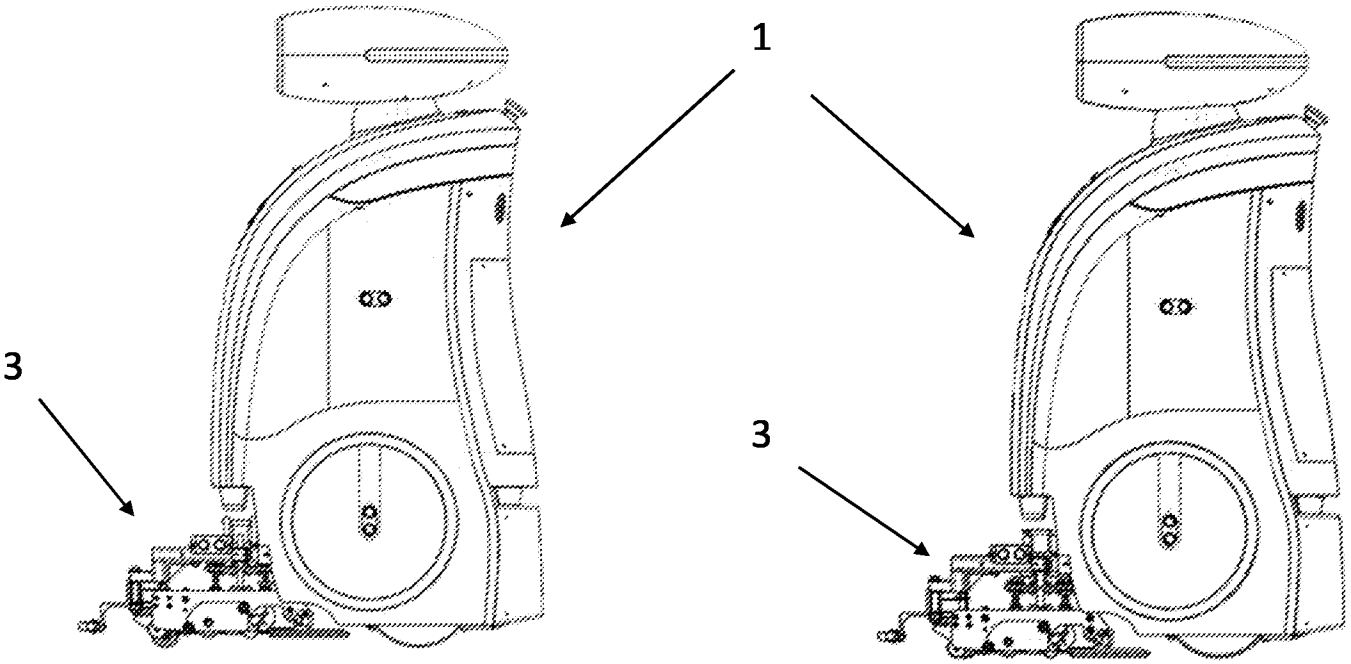
FIG. 14 is a side view of the autonomous cleaning apparatus of FIG. 1 with the floor mopping system shown in a raised position.
FIG. 15 is a side view of the autonomous cleaning apparatus of FIG. 1 with the floor mopping system shown in a lowered position.

The suspension assembly 63 further comprises a positioning mechanism 79 for positioning the mop roller assembly 5 between an elevated nonoperational position when the mop roller assembly 5 is above and not in contact with the floor surface as shown in FIG. 14, and a lowered operational position where the mop roller assembly 5 is in contact with the floor surface as shown in FIG. 15. The positioning mechanism 79 comprises an upper bracket 81 positioned above the support plate 67. An actuator motor 83 may be mounted on the upper bracket 81, and a lead screw 83 may extend downwardly from the actuator motor 83 and may engage a threaded boss 87 secured to the underlying support plate 67. One or more guide posts 89 may extend upwardly from the support plate 67 and through apertures 91 provided in the upper bracket 81. This arrangement constrains the movement of the support plate 67 relative to the upper bracket 81 to generally vertical motion while minimising sideways motion of the support plate 67 relative to the upper bracket 81. Rotation of the lead screw 85 in one rotational direction can therefore act to elevate the mop roller assembly 5 above the floor surface before or after use of the mop roller assembly 5. Rotational motion of the lead screw 85 in an opposing direction will lower the mop roller assembly 5 until the wheel assemblies 31,41 and the roller mop 9 of the mop roller assembly 5 are in contact with the floor surface. The actuator motor 83 can also act to apply downward pressure through compression of the resilient means 70. This allows the suspension assembly 63 to take into account unevenness in the floor surface that would otherwise lead to patchy cleaning results in the case of conventional cleaning robots. The mop roller assembly 5 according to the present disclosure can therefore handle both depressions and raised areas within that floor surface. The wheel assemblies 31,41 assist in constraining and limiting the distance between the longitudinal rotational axis 17 of the mop roller 9 and the floor surface to thereby ensure that the pressure applied by the mop roller 9 on the floor surface is optimal. Too much pressure may lead to the mop roller 9 being squeezed against the floor surface resulting in water leaking from the mop roller 9.

During the cleaning operation of the floor mopping system 3 according to the present disclosure, the following steps can happen simultaneously:

a) Clean water is sprayed onto the mop roller 9 at equal intervals. (these intervals can for example be adjusted via a mobile app);
b) The mop roller 9 is rotating against the floor surface (rotational mopping);
c) The mop roller 9 is being scrapped against the scrapper member 43 squeezing the dirty water out of the mop roller 9 and leading the dirty water to the tray member 45;
d) The dirty water is being pumped out of the tray member 45 at equal intervals to the dirty water tank (these intervals can be adjusted via the mobile app); and
e) The static mop pad 55 is in contact with the floor surface wiping off any residual water marks on the floor surface.

It should be appreciated by the person skilled in the art that the above invention is not limited to the embodiment described. It is appreciable that modifications and improvements may be made without departing from the scope of the present invention.

It should be further appreciated by the person skilled in the art that one or more of the above modifications or improvements, not being mutually exclusive, may be further combined to form yet further embodiments of the present invention.

The invention claimed is:

1. A floor mopping system for an autonomous cleaning apparatus, comprising a mop roller assembly including a mop roller and a drive mechanism for rotatably driving the mop roller about a longitudinal axis thereof, the mop roller assembly comprising a mop roller housing for accommodating the mop roller and the drive mechanism, wherein the drive mechanism comprises a drive motor, a mop roller drive assembly and a belt drive assembly interconnecting the drive motor and mop roller drive assembly, the mon roller drive assembly being interconnected to the mop roller;

wherein the mop roller assembly is supported on a suspension assembly comprising an adaptive suspension mechanism for providing at least 3 degrees of movement for the mop roller assembly, the adaptive suspension system comprising one or more resilient supports interconnected to the mop roller housing for resiliently supporting the mop roller assembly;

wherein the adaptive suspension system comprises a support plate positioned in a generally parallel adjacent relationship to a top surface of the mop roller housing, the resilient support being located between the support plate and top surface thereof; and wherein the resilient support comprises a spherical bearing block respectively mounted on the support plate and the top surface, a coil spring located between the support plate and the top surface, and a guide pin extending through the spherical bearing blocks and the coil spring for locating the coil spring in position, wherein the guide pin is angularly displaced and pivots within each spherical bearing blocks.

2. The floor mopping system according to claim 1, wherein the support plate is generally rectangular in shape, and wherein a said resilient support is respectively located at or adjacent each corner of the support plate.

3. The floor mopping system according to claim 1, the suspension assembly further comprising a positioning mechanism for positioning the mop roller assembly between an elevated non-operational position, and a lowered operational position wherein the positioning mechanism comprises an actuator drive means comprising a drive screw for moving the mon roller assembly between said elevated and lowered positions.

4. The floor mopping system according to claim 1, further comprising a cleaning assembly for the mop roller.

5. The floor mopping system according to claim 4, wherein the cleaning assembly comprises a scrapper member in contact with the mop roller for extracting water therefrom.

6. The floor mopping system according to claim 5, wherein the cleaning assembly further comprises a tray member for receiving the extracted water, and drainage means for removing the water collected by the tray member, wherein the drainage means comprises a drain outlet connector and a dosing pump for removing the water collected by the tray member.

7. The floor mopping system according to claim 1, the mop roller assembly further comprising a static mopping pad having a removable mopping pad mounted thereon.

8. The floor mopping system according to claim 1, wherein the mop roller is removably mounted within the mop roller assembly.

9. An autonomous cleaning apparatus comprising a floor mopping system as claimed in claim 1.

10. The autonomous cleaning apparatus according to claim 9, comprising an electronic control system for controlling the operation of the floor mopping system, and a water supply system for supplying clean water to the floor mopping system and for collecting dirty water from the floor mopping system.

11. The autonomous cleaning apparatus according to claim 9, wherein the control system controls an interval of the supply of clean water to the floor mopping system.

* * * * *